US009421778B2

(12) United States Patent
Shindo

(10) Patent No.: US 9,421,778 B2
(45) Date of Patent: Aug. 23, 2016

(54) LIQUID DISCHARGE APPARATUS

(71) Applicant: Brother Kogyo Kabushiki Kaisha, Nagoya-shi, Aichi-ken (JP)

(72) Inventor: Tatsuya Shindo, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/668,002

(22) Filed: Mar. 25, 2015

(65) Prior Publication Data

US 2015/0273838 A1 Oct. 1, 2015

(30) Foreign Application Priority Data

Mar. 27, 2014 (JP) ..... 2014-066016

(51) Int. Cl.

| | |
|---|---|
| ***B41J 2/165*** | (2006.01) |
| ***B41J 2/17*** | (2006.01) |
| ***B41J 2/175*** | (2006.01) |
| ***B41J 29/17*** | (2006.01) |

(52) U.S. Cl.

CPC ..... *B41J 2/1714* (2013.01); *B41J 2/16538* (2013.01); *B41J 2/17509* (2013.01); *B41J 29/17* (2013.01); *B41J 2/16508* (2013.01)

(58) Field of Classification Search

CPC ..... B41J 2/16535; B41J 2/16538; B41J 2/16585; B41J 2/16547; B41J 2/16541; B41J 2/16544; B41J 2002/1655; B41J 2002/16558; B41J 2/04516; B41J 2/1714; B41J 2002/1853; B41J 2/16523; B41J 2/1721; B41J 2002/1728; B41J 2002/1735

See application file for complete search history.

(56) References Cited

U.S. PATENT DOCUMENTS

| | | | | |
|---|---|---|---|---|
| 6,036,299 | A * | 3/2000 | Kobayashi et al. | 347/30 |
| 2002/0122092 | A1 | 9/2002 | Okamura et al. | |
| 2003/0184612 | A1* | 10/2003 | Umeda | 347/30 |
| 2011/0316928 | A1* | 12/2011 | Roth et al. | 347/33 |

FOREIGN PATENT DOCUMENTS

| | | |
|---|---|---|
| JP | 2000-103085 | 4/2000 |
| JP | 2000-141677 | 5/2000 |
| JP | 2003-025596 | 1/2003 |
| JP | 2006-076094 | 3/2006 |

* cited by examiner

*Primary Examiner* — Julian Huffman
*Assistant Examiner* — Jeremy Delozier
(74) *Attorney, Agent, or Firm* — Frommer Lawrence & Haug LLP

(57) ABSTRACT

There is provided a liquid discharge apparatus including: a liquid jet head having a liquid jet surface with a plurality of nozzles formed therein to jet a liquid, and being configured to move in a scanning direction; a head movement unit supplying the liquid jet head with a power for moving the liquid jet head in the scanning direction; a wiper configured to wipe off the liquid adhering to the liquid jet surface of the liquid jet head by moving relative to the liquid jet head; and a cleaning member formed of a material capable of absorbing the liquid, provided within a range for the liquid jet head to move in the scanning direction, and configured to contact with the liquid adhering to a lateral surface of the liquid jet head by a movement of the liquid jet head in the scanning direction.

19 Claims, 8 Drawing Sheets

LIQUID DISCHARGE APPARATUS

CROSS REFERENCE TO RELATED APPLICATION

The present application claims priority from Japanese Patent Application No. 2014-066016, filed on Mar. 27, 2014, the disclosure of which is incorporated herein by reference in its entirety.

BACKGROUND

1. Field of the Invention

The present invention relates to liquid discharge apparatuses discharging liquid.

2. Description of the Related Art

In liquid discharge apparatuses including a liquid jet head jetting a liquid, if some of the liquid adheres to and remains on a liquid jet surface in which a plurality of nozzles of the liquid jet head are arranged, then some problems will occur such as impeding liquid jet from each nozzle to give rise to jet defection, etc. Therefore, ordinary liquid discharge apparatuses include a wiper adapted to wipe off the liquid adhering to the liquid jet surface of the liquid jet head.

For example, there are known ink jet printers including a recording head to jet ink while moving in a scanning direction, and a wiper to wipe off the ink adhering to an ink jet surface (facing surface) of the recording head.

Further, in such an ink jet printer, there may be a problem that when the wiper has wiped off the ink adhering to the ink jet surface of the recording head, part of the ink remains adhering and sticking to a lateral surface of the recording head. Therefore, there are known ink jet printers further including a scraper to remove the ink adhering to the lateral surface of the recording head. The scraper is integrated with a cap to cover the ink jet surface of the recording head. Along with raising and lowering the cap, the scraper moves up and down along the lateral surface of the recording head with only a little interspace left between the scraper and the lateral surface of the recording head. The scraper scrapes off the thickened ink accumulated above a certain height on the lateral surface of the recording head.

SUMMARY

In such an ink jet printer as mentioned above, in order for the scraper to scrape off the thickened ink accumulated on the lateral surface of the recording head, it is necessary to move the scraper along the lateral surface of the recording head. When a configuration should be provided particularly for that purpose, then the number of components would increase so as to complicate the configuration of the apparatus. In this respect, there is also a known configuration in which the scraper is integrated with the cap, and driven to move up and down together with the cap. In this configuration, however, it is possible for the scraper to scrape only at a particular timing for the cap to move up and down. That is, because it is not possible to drive the scraper independently, there is only a limited timing for the scraper to clean the lateral surface of the recording head.

Accordingly, it is an object of the present teaching to provide a liquid discharge apparatus capable of removing the liquid adhering to a lateral surface of a liquid jet head without moving a cleaning member.

According to an aspect of the present teaching, there is provided a liquid discharge apparatus configured to discharge liquid, including: a liquid jet head including a liquid jet surface in which a plurality of nozzles is formed, and being configured to move in a scanning direction;

a head movement unit configured to supply the liquid jet head with a power for moving the liquid jet head in the scanning direction;

a wiper configured to wipe off the liquid adhered to the liquid jet surface of the liquid jet head by moving relative to the liquid jet head; and a cleaning member formed of a material of absorbing the liquid, provided within a range for the liquid jet head to move in the scanning direction, and configured to contact with the liquid adhering to a lateral surface of the liquid jet head by a movement of the liquid jet head in the scanning direction.

According to the present teaching, the cleaning member is provided within the range for the liquid jet head to move in the scanning direction. Then, if the liquid jet head moves in the scanning direction to reach the position of providing the cleaning member, then on this occasion, the cleaning member contacts with the liquid adhering to lateral surface of the liquid jet head. By virtue of this, the cleaning member absorbs and removes the ink adhering to the lateral surface of the liquid jet head when the wiper wipes the liquid jet surface. According to the present teaching, because it is possible for the cleaning member to contact with the liquid adhering to the lateral surface of the liquid jet head by moving the liquid jet head, it is not necessary to move the cleaning member, and thus the configuration therefor is not needed.

According to the present teaching, by causing the cleaning movement unit to move the cleaning member in a direction parallel to the lateral surface of the liquid jet head, it is possible to reliably remove the liquid adhering to the lateral surface of the liquid jet head.

BRIEF DESCRIPTION OF THE DRAWINGS

FIGS. 2A to 2C are front views of an ink jet head and a maintenance unit, wherein FIG. 2A shows a state in purging, FIG. 2B shows a state in starting to wipe an ink jet surface, and FIG. 2C shows a state in wiping the ink jet surface;

DESCRIPTION OF THE EMBODIMENT

Figure 1:
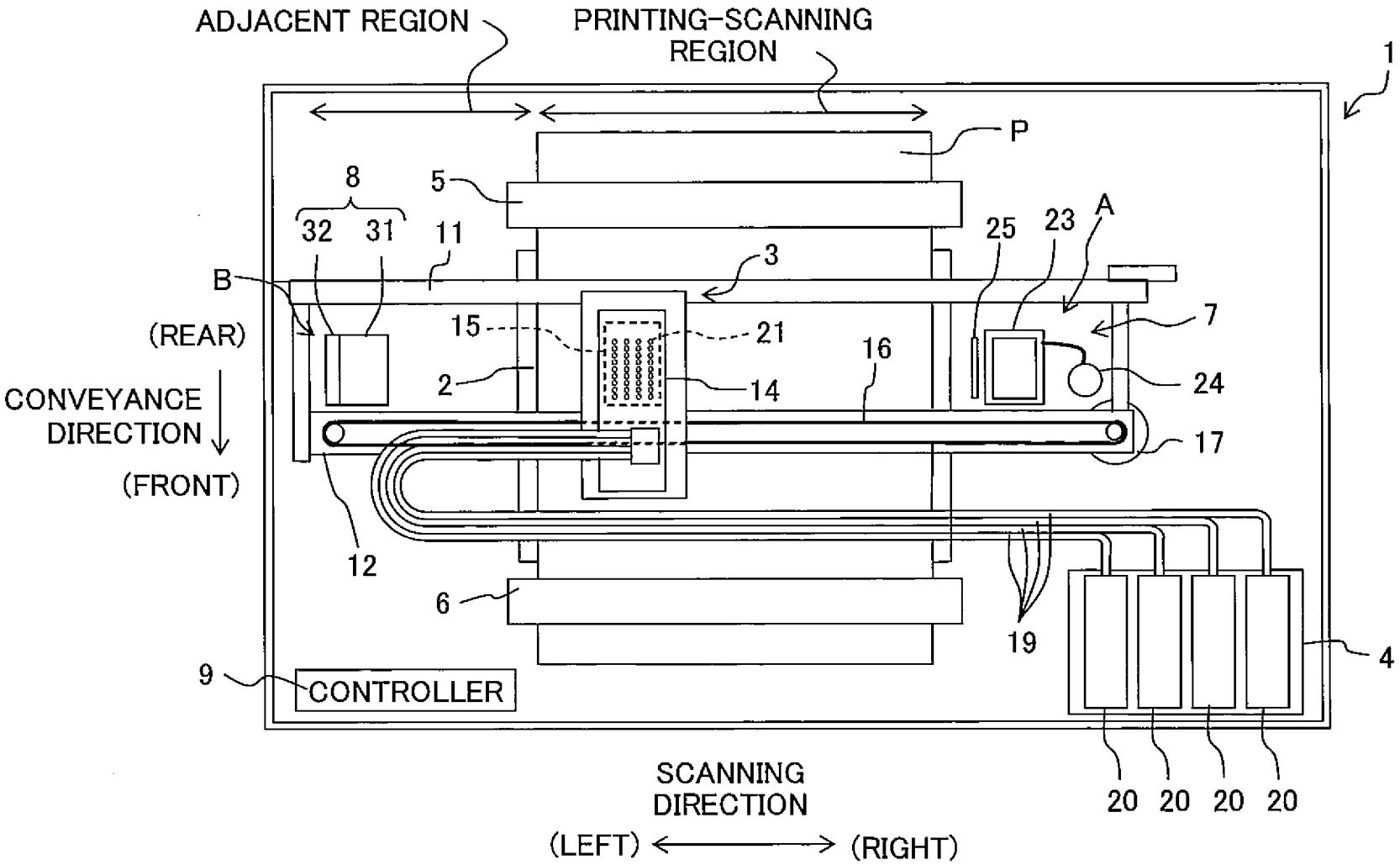
FIG. 1 is a schematic plan view of a printer according to a preferred embodiment of the present teaching.

Hereinbelow, an embodiment of the present teaching will be explained. As depicted in FIG. 1, a printer 1 (the liquid discharge apparatus of the present teaching) includes a platen 2, an ink jet head 3, a holder 4, a paper feed roller 5, a paper discharge roller 6, a maintenance unit 7, an ink receiving member 8, a controller 9, etc. Further, the respective directions of front, rear, left and right depicted in FIG. 1 are defined as "front", "rear", "left" and "right" of the printer. Further, the near side of the page of FIG. 1 is defined as "upper" or "up", while the far side of the page is defined as "lower" or "down". The following explanation will use each directional term of the front, rear, left, right, upper or up, and lower or down as appropriate.

<Schematic Configuration of the Printer>

A sheet of recording paper P as a recording medium is positioned on the upper surface of the platen 2. Further, above the platen 2, two guide rails 11 and 12 are provided parallel to a left-right direction (to be also referred to below as a scanning direction).

The ink jet head 3 (the liquid jet head of the present teaching) includes a carriage 13, a sub-tank 14, and an ink jet unit 15. The carriage 13 is configured to be movable in the scanning direction along the two guide rails 11 and 12 in an area facing the platen 2. The carriage 13 is connected to an endless drive belt 16, and a head drive motor 17 (the head movement unit of the present teaching) drives the drive belt 16 to move the carriage 13 in the scanning direction.

The sub-tank 14 is mounted on the carriage 13. A tube joint 18 is provided on the upper surface of the sub-tank 14, and connected with four ink supply tubes 19 connected with the holder 4. Four ink cartridges 20 are installed in the holder 4 in an exchangeable manner to respectively retain four types of ink (black, yellow, cyan and magenta). Then, the sub-tank 14 is supplied with the four types of ink retained respectively in the four ink cartridges 20 via the four ink supply tubes 19.

The ink jet unit 15 is fitted below the sub-tank 14. The ink jet unit 15 has a plurality of nozzles 21 formed in the lower surface thereof. Further, the lower surface of the ink jet unit 15, where the plurality of nozzles 21 are formed, is referred to as an ink jet surface 15*a* (see FIGS. 2A to 2C, and FIG. 3: corresponding to the liquid jet surface of the present teaching). The ink jet unit 15 jets the inks supplied from the sub-tank 14 from the plurality of nozzles 21, respectively. The plurality of nozzles 21 are aligned to form four nozzle rows which correspond to the four types of ink.

The paper feed roller 5 and the paper discharge roller 6 are driven synchronously with each other to rotate by a transport motor (not depicted). The paper feed roller 5 and the paper discharge roller 6 cooperate to transport the recording paper P positioned on the platen 2 in a frontward direction (to be also referred to below as a conveyance direction).

The maintenance unit 7 is arranged in an end position on the right side (to be also referred to as a maintenance position A) within the range for the ink jet head 3 to move in the scanning direction. The maintenance unit 7 includes a cap member 23, a suction pump 24, a wiper 25, etc. The maintenance unit 7 carries out operations such as suction purge and the like for maintaining and recovering the jet function of the plurality of nozzles 21 of the ink jet head 3. Details of the maintenance unit 7 will be explained later on.

The ink receiving member 8 is arranged in an end position on the left side (to be also referred to as a flushing position B) within the range for the ink jet head 3 to move in the scanning direction. The ink receiving member 8 is formed of a material capable of absorbing the inks (a porous material, for example). The ink receiving member 8 is configured to absorb the ink and the like jetted from the plurality of nozzles 21 in flushing the ink jet head 3. The ink receiving member 8 may be formed of a member of which surface includes a plurality of fine grooves. In this case, the ink is drawn into the grooves by the capillary force. Details of the ink receiving member 8 will also be explained later on.

The controller 9 (the controller of the present teaching) includes a ROM (Read Only Memory), a RAM (Random Access Memory), an ASIC (Application Specific Integrated Circuit) including various control circuits, etc. Subject to programs stored in the ROM and with the ASIC, the controller 9 carries out various processes such as printing on the recording paper P, and the like. In the printing process, for example, based on a print command input from an external device such as a PC or the like, the controller 9 controls the ink jet unit 15, the head drive motor 17, and the like, to print images and the like on the recording paper P. Further, it controls the suction pump 24 and the like of the maintenance unit 7 to carry out the maintenance operation such as the suction purge and the like.

<Details of the Maintenance Unit>

Figure 2A:
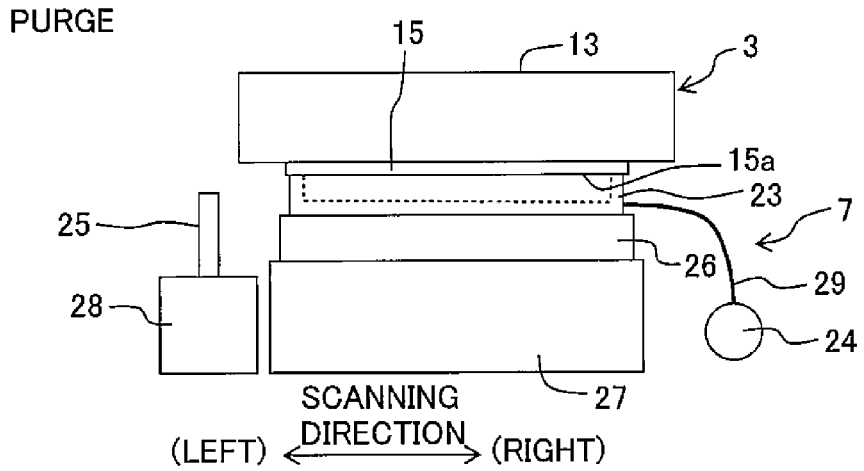
Figure 2B:
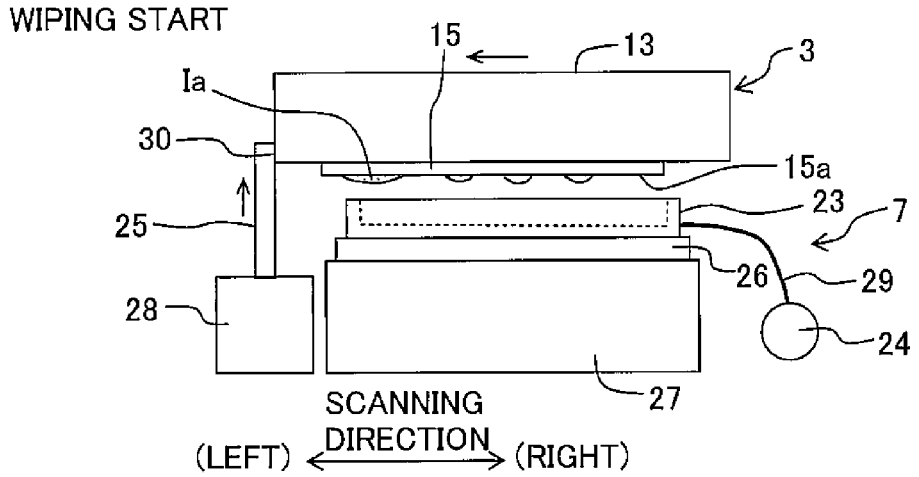
Figure 2C:
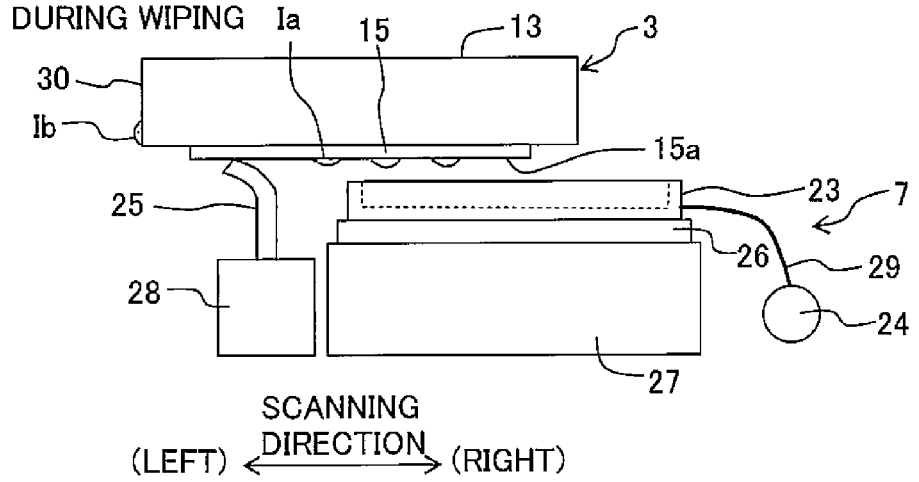

Next, a detailed configuration of the maintenance unit 7 will be explained. FIGS. 2A to 2C are front views of the ink jet head 3 and the maintenance unit 7. As depicted in FIGS. 1 and 2A to 2C, the maintenance unit 7 includes the cap member 23, the suction pump 24, and the wiper 25.

The cap member 23 is formed of rubber, synthetic resin, or the like. The cap member 23 is held by a cap lift holder 26 thereunder. A cap drive portion 27 including a motor and the like drives the cap lift holder 26 to move up and down. By virtue of this, the cap member 23 moves up and down together with the cap lift holder 26. A tube 29 connects the suction pump 24 to the cap member 23.

When the ink jet head 3 has moved to the maintenance position A of FIG. 1, the ink jet surface 15*a* of the ink jet head 3 comes into such a state as to face the cap member 23 vertically, as depicted in FIGS. 2A to 2C. From this state, when the cap drive portion 27 drives the cap lift holder 26 to move upward, then the cap member 23 also moves upward simultaneously. Then, the cap member 23 is attached tightly to the ink jet surface 15*a* of the ink jet head 3 to cover the plurality of nozzles 21. In this state, by actuating the suction pump 24 to depressurize the inside of the cap member 23, the inks are sucked and forcibly discharged from the plurality of nozzles 21. By virtue of this, from the ink jet unit 15, there are discharged foreign substances, air bubbles, high viscosity inks due to drying, and the like inside the ink jet unit 15 (this operation is called the suction purge). It is possible to perform a pressurized purge in which the ink in the nozzles 21 is pressurized to forcibly discharge the ink from the nozzles 21, by using a pressure pump in place of the suction pump 24.

The wiper 25 is a plate-like member formed of a flexible material such as rubber, synthetic resin or the like. The wiper 25 is arranged on the left side of the cap member 23 to assume a posture parallel to the up-down direction. Further, the wiper 25 is driven to move up and down by a wiper drive portion 28 including a motor and the like. As depicted in FIGS. 2B and 2C, when the leading end of the wiper 25 is positioned above the ink jet surface 15*a* of the ink jet head 3, and when the ink jet head 3 moves in the scanning direction, then the wiper 25 moves relative to the ink jet surface 15*a* to wipe the ink jet surface 15*a*.

While no particular limitation is imposed on the timing for the wiper 25 to wipe the ink jet surface 15*a*, an explanation will be made below on a wiping process after the suction purge described above. As depicted in FIG. 2B, after the suction purge is finished, the cap drive portion 27 moves the cap member 23 downward to separate the cap member 23 from the ink jet surface 15*a*. At this time, a part of the ink Ia discharged in the suction purge is adhering to the ink jet surface 15*a* immediately after being separated from the cap member 23.

In order to wipe off the ink Ia adhering to the ink jet surface 15*a*, first, the wiper drive portion 28 moves the wiper 25 upward. At this time, the leading end of the wiper 25 moves up to a position above the lower end of the carriage 13 of the ink jet head 3. In this state, when the ink jet head 3 moves leftward, then first, as depicted in FIG. 2B, the leading end of the wiper 25 contacts with a left lateral surface 30 of the carriage 13. When the ink jet head 3 further moves leftward, then the leading end of the wiper 25 comes to bend while in contact with the ink jet surface 15*a*, and moves rightward relative to the ink jet surface 15*a*. By virtue of this, the wiper 25 wipes off the ink Ia adhering to the ink jet surface 15*a*.

Further, the ink Ia, which was wiped off from the ink jet surface 15*a* by the wiper 25, is now adhering to the wiper 25. While a large part of this ink comes to drop downward along the wiper 25 due to the gravity, a part of the ink still remains on the leading end of the wiper 25. Then, the next time the wiper 25 wipes the ink jet surface 15*a*, as depicted in FIG. 2B, the leading end of the wiper 25 may come to contact with the left lateral surface 30 of the carriage 13 immediately before the wiping. In this case, as depicted in FIG. 2C, an ink Ib remaining on the wiper 25 may come to adhere to the left lateral surface 30 of the carriage 13.

After the ink Ib has come from the wiper 25 to adhere to the left lateral surface 30 of the carriage 13, when a certain period of time has passed, the next chance comes for the wiper 25 to wipe the ink jet surface 15*a* again. On this occasion, when the leading end of the wiper 25 has contacted with the left lateral surface 30 of the carriage 13, the ink adhering to the left lateral surface 30 of the carriage 13 and being a little thickened comes to adhere to the wiper 25. In this state, if the wiper 25 were to wipe the ink jet surface 15*a*, then the thickened ink adhering to the wiper 25 would inversely come to adhere to the ink jet surface 15*a*, and hence to inevitably cause jet defection again with the nozzles 21 which should have recovered its jet function through the suction purge.

Further, other than the above problem, if the carriage 13 moves while the ink Ib remains in adherence to the left lateral surface 30 of the carriage 13 as it is, then the ink is liable to drop from the left lateral surface 30 of the carriage 13 during the moving. In this embodiment, however, in order to prevent these problems from happening, an aftermentioned cleaning portion 32 is used to remove the ink adhering to the left lateral surface 30 of the carriage 13.

<Details of the Ink Receiving Member>

Figure 3:
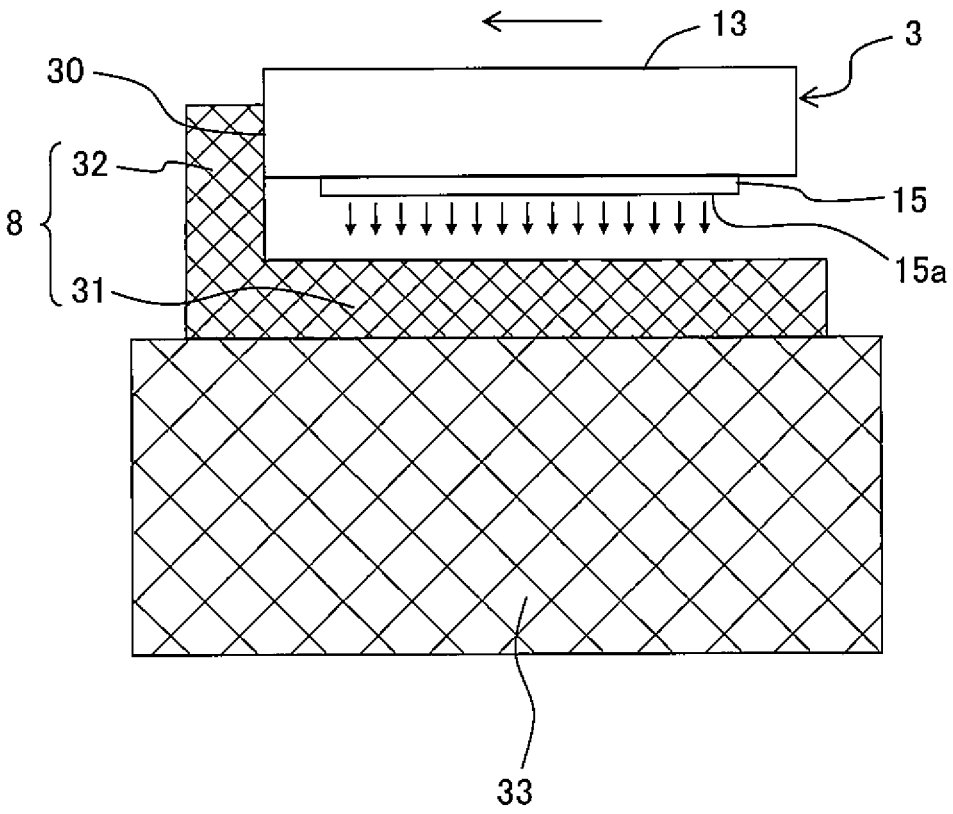
FIG. 3 is a front view of the ink jet head and an ink receiving member.

Next, a detailed configuration of the ink receiving member 8 will be explained. FIG. 3 is a front view of the ink jet head 3 and the ink receiving member 8. As depicted in FIG. 3, the ink receiving member 8 has a flushing receiving portion 31 (the flushing receiving member of the present teaching) arranged along a horizontal plane, and a cleaning portion 32 (the cleaning member of the present teaching) extending upward from the left end of the flushing receiving portion 31, and is approximately L-shaped in planar view. Further, under the ink receiving member 8, an ink absorption member 33, which is formed of a material capable of absorbing the ink in analogy with the ink receiving member 8, is arranged in contact with the ink receiving member 8. Further, the ink absorption member 33 has a larger volume and a larger capacity of absorbing the inks than the ink receiving member 8.

In this embodiment, at an appropriate timing, the ink jet head 3 carries out an operation called flushing. The flushing mentioned here refers to a process of jetting the ink from each of the plurality of nozzles 21 a plurality of times toward the flushing receiving portion 31 of the ink receiving member 8. While the flushing has various purposes, there are such reasons, for example, as to prevent the inks inside the nozzles 21 from drying, to shape up the meniscus inside the nozzles 21 after the suction purge, and the like.

In order for the ink jet head 3 to carry out the flushing, when the ink jet head 3 moves to the flushing position B of FIG. 1, the ink jet surface 15*a* of the ink jet head 3 comes to vertically face the flushing receiving portion 31 of the ink receiving member 8, as depicted in FIG. 3. In this state, the flushing receiving portion 31 receives the ink jetted from the plurality of nozzles 21 of the ink jet head 3. Further, when the ink jet head 3 has moved to the flushing position B, the left lateral surface 30 of the ink jet head 3 (the carriage 13) contacts with the cleaning portion 32. By virtue of this, as depicted in FIG. 2C, even when the ink Ib from the wiper 25 is adhering to the left lateral surface 30 of the carriage 13, the cleaning portion 32 still absorbs the ink Ib on the left lateral surface 30.

<A Series of the Maintenance Processes for the Ink Jet Head 3>

Figure 4:
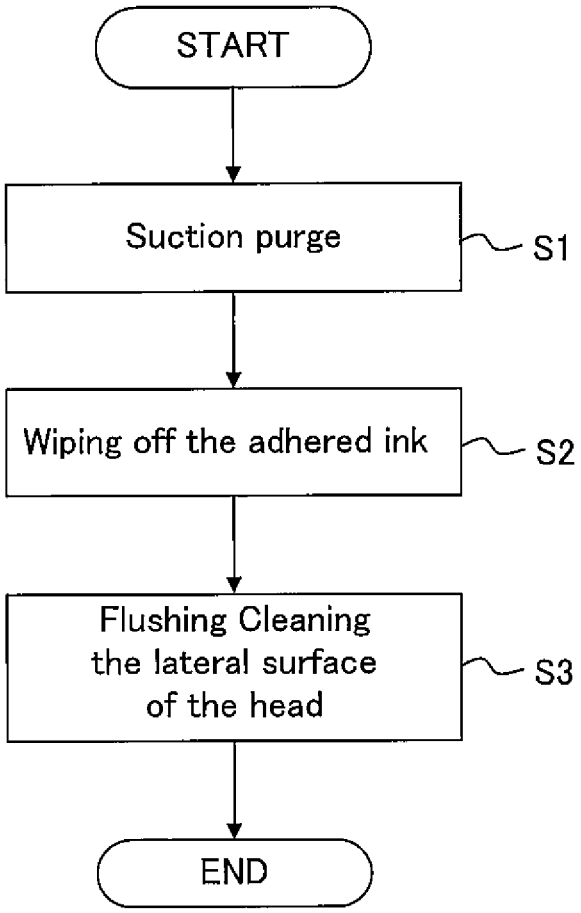
FIG. 4 is a flowchart of a maintenance process.

Next, referring to the flowchart of FIG. 4, an explanation will be made on a series of the maintenance processes to be carried out by the controller 9, related to recovery and maintenance of the ink jet head 3 from jet defection. Further, the symbol Si (i=1, 2, and 3) used in FIG. 4 denotes each step number of the maintenance processes.

When there is a situation which is giving rise to jet defection of the nozzles 21 of the ink jet head 3, or a situation which may give rise to jet defection because the inks have not been jetted for a while, then the controller 9 controls the maintenance unit 7 to carry out the suction purge (S1: purge process). Such situations can be taken as examples for which the suction purge is needed, that the ink jet head 3 has not been used for a certain period of time, the user has entered a command requiring the suction purge to be carried out from an operation panel (not depicted) of the printer 1, etc.

The controller 9 controls the head drive motor 17 to move the ink jet head 3 to the maintenance position A of FIG. 1 and, as depicted in FIG. 2A, to cause the ink jet surface 15*a* of the ink jet head 3 to face the cap member 23. Next, the controller 9 controls the cap drive portion 27 to move the cap member 23 upward to cause the cap member 23 to appress the ink jet surface 15*a*. By virtue of this, the plurality of nozzles 21 in the ink jet surface 15*a* come to be covered by the cap member 23. In this state, the controller 9 actuates the suction pump 24 to depressurize the inside of the cap member 23, so as to forcibly discharge the ink from the plurality of nozzles 21 of the ink jet head 3. After the suction pump 24 is finished with the suction purge, the controller 9 controls the cap drive portion 27 to move the cap member 23 downward to be separated from the ink jet surface 15*a*.

Next, after the suction purge is finished, as depicted in FIG. 2B, the ink Ia is adhering to the ink jet surface 15*a*. Therefore, the controller 9 causes the wiper 25 to wipe off the ink Ia adhering to the ink jet surface 15*a* (S2: wiping process). First, the controller 9 controls the wiper drive portion 28 to raise the wiper 25. Next, it controls the head drive motor 17 to move the ink jet head 3 leftward. On this occasion, as depicted in FIG. 2B, the leading end of the wiper 25 comes to contact with the left lateral surface 30 of the carriage 13. Further, by moving the ink jet head 3 leftward, as depicted in FIG. 2C, the leading end of the wiper 25 in a bent state is wiping off the ink Ia adhering to the ink jet surface 15*a*. Further, on this occasion, as described earlier, it is possible for the ink Ib remaining on the wiper 25 before the wiping to adhere to the left lateral surface 30 of the carriage 13.

Because of the suction purge, and the wiping thereafter by the wiper 25, it is possible for the meniscus of the ink in the plurality of nozzles 21 to be unstable. Therefore, in order to shape up the meniscus of the inks in each of the nozzles 21, after the wiper 25 wipes the ink jet surface 15*a*, the controller 9 successively causes the ink jet head 3 to carry out the flushing (S3). That is, the controller 9 controls the head drive motor 17 to move the ink jet head 3 to the flushing position B of FIG. 1 and, as depicted in FIG. 3, causes the ink jet surface 15*a* to face the flushing receiving portion 31 of the ink receiving member 8 (head movement process). In this state, the ink is jetted respectively from the plurality of nozzles 21 of the ink jet head 3 toward the flushing receiving portion 31 (flushing process).

Here, when the ink jet head 3 has moved to the flushing position B, the left lateral surface 30 of the carriage 13 is in contact with the cleaning portion 32 of the ink receiving member 8. Therefore, even when the ink is adhering to the left lateral surface 30 of the carriage 13, the cleaning portion 32 still absorbs and removes the ink. When the printing is performed, the ink jet head is scanned within the region facing the recording paper P (a printing-scanning region, see FIG. 1) to jet the ink onto the recording paper P. When the controller 9 determines that it is necessary to perform cleaning of the lateral surface 30 of the carriage 13, the ink jet head is moved to an adjacent region which includes the flushing position B and which is adjacent to the printing-scanning region in the scanning direction to perform cleaning of the lateral surface 30 of the carriage 13. Then the cleaning portion 32 may be deformed by contacting the lateral surface 30 of the lateral surface 30 of the carriage 13. If the cleaning portion 32 is deformed by contacting the lateral surface 30 of the lateral surface 30 of the carriage 13 frequently, the cleaning portion 32 may deteriorate rapidly. Therefore, the controller may control the cleaning portion 32 such that only when the controller 9 determines it is necessary to perform cleaning of the lateral surface 30 of the carriage 13, the cleaning portion 32 may be deformed by contacting the lateral surface 30 of the lateral surface 30 of the carriage 13. For example, when the flushing operation is performed, the cleaning portion 32 may be deformed by contacting the lateral surface 30 of the lateral surface 30 of the carriage 13. Or, when a command to perform the cleaning of the lateral surface is input by the user, the cleaning portion 32 may be deformed by contacting the lateral surface 30 of the lateral surface 30 of the carriage 13.

As explained earlier, in this embodiment, the cleaning portion 32 is provided within the range for the ink jet head 3 to move in the scanning direction. The ink jet head 3 moves up to the position of the cleaning portion 32 for the cleaning portion 32 to contact with the left lateral surface 30 of the ink jet head 3 (the carriage 13). On this occasion, the cleaning portion 32 absorbs and removes the ink adhering to the lateral surface of the carriage 13 when the wiper 25 wipes the ink jet surface 15*a*. In this manner, because it is possible for the cleaning portion 32 to contact with the lateral surface of the carriage 13 by moving the ink jet head 3, it is not necessary to move the cleaning portion 32, and thus the configuration therefor is not needed.

Further, in this embodiment, because the cleaning portion 32 is located at an end position in the range for the ink jet head 3 to move in the scanning direction, when images and the like are printed on the recording paper P, the cleaning portion 32 does not come in the way when the ink jet head 3 jets the inks while moving leftward and rightward in a central part in the aforementioned movement range.

In this embodiment, when wiping the ink jet surface 15*a*, first, the wiper 25 comes to contact with the left lateral surface 30 of the ink jet head 3 (the carriage 13) and, in this state by moving the ink jet head 3 leftward, the wiper 25 wipes the ink jet surface 15*a*. On this occasion, when the wiping is carried out this time with part of the ink wiped off previously still remaining on the wiper 25, then the ink adhering to the wiper 25 may come to adhere to the left lateral surface 30 of the ink jet head 3. In this embodiment, after the wiper 25 is finished with the wiping, the ink jet head 3 is successively moved leftward up to the left end position (the flushing position B) in the movement range, so as to cause the cleaning portion 32 installed at the left end position to contact with the left lateral surface 30 of the ink jet head 3. By virtue of this, following the wiping by the wiper 25, it is possible to simply clean the left lateral surface 30 of the ink jet head 3 to which the ink may adhere in that wiping.

Further, in this embodiment, the flushing receiving portion 31 and the cleaning portion 32 are arranged in the same position (the flushing position B). Therefore, when the ink jet head 3 has moved up to the flushing position B for carrying out the flushing, the cleaning portion 32 contacts with the left lateral surface 30 of the carriage 13 to remove the ink adhering to the left lateral surface 30 of the carriage 13. That is, it is possible for the cleaning portion 32 to clean the left lateral surface 30 of the carriage 13 simultaneously with flushing the ink jet head 3.

As described above, the left lateral surface 30 of the ink jet head 3 (the carriage 13) to which the ink may adhere in the wiping is cleaned after the wiping by the wiper 25. Therefore, it is possible to clean the left lateral surface 30 of the ink jet head 3 before the ink on the left lateral surface 30 is solidified. Further, it takes a few seconds to finish cleaning the left lateral surface 30 of the ink jet head 3 after the cleaning portion 32 contacts with the left lateral surface 30. In this embodiment, it is possible for the cleaning portion 32 to clean the left lateral surface 30 of the carriage 13 simultaneously with flushing the ink jet head 3. Therefore, it is possible to reduce time as compared with the case in which cleaning by the cleaning portion 30 and flushing of the ink jet head 3 are performed separately.

The cleaning portion 32 is formed of a material capable of absorbing the ink. When the process is carried out a number of times to remove the ink adhering to the lateral surface of the ink jet head 3, then it is predictable that the cleaning portion 32 may gradually become saturated such that the cleaning portion 32 cannot absorb the ink anymore. In this embodiment, therefore, the flushing receiving portion 31 and the cleaning portion 32 are integrated to construct the one ink receiving member 8. Further, the ink receiving member 8 is connected with the ink absorption member 33. That is, the flushing receiving portion 31 and the cleaning portion 32 are connected with the common ink absorption member 33. First, the ink jetted into the flushing receiving portion 31 are absorbed into the ink absorption member 33 from the flushing receiving portion 31. Further, because the cleaning portion 32 is also connected to the ink absorption member 33 in common use with the flushing receiving portion 31, the ink absorbed by the cleaning portion 32 from the left lateral surface 30 of the carriage 13 also flows into the ink absorption member 33. That is, because the ink absorbed by the cleaning portion 32 flows into the ink absorption member 33 for absorbing the ink jetted in the flushing, the ink absorption function of the cleaning portion 32 is maintained for a long period of time.

Next, explanations will be made on a few modifications applying various changes to the above embodiment. However, the same reference numerals are assigned to the components of similar configurations to those in the above embodiment, and the explanation therefor will be omitted as appropriate.

<First Modification>

Figure 5:
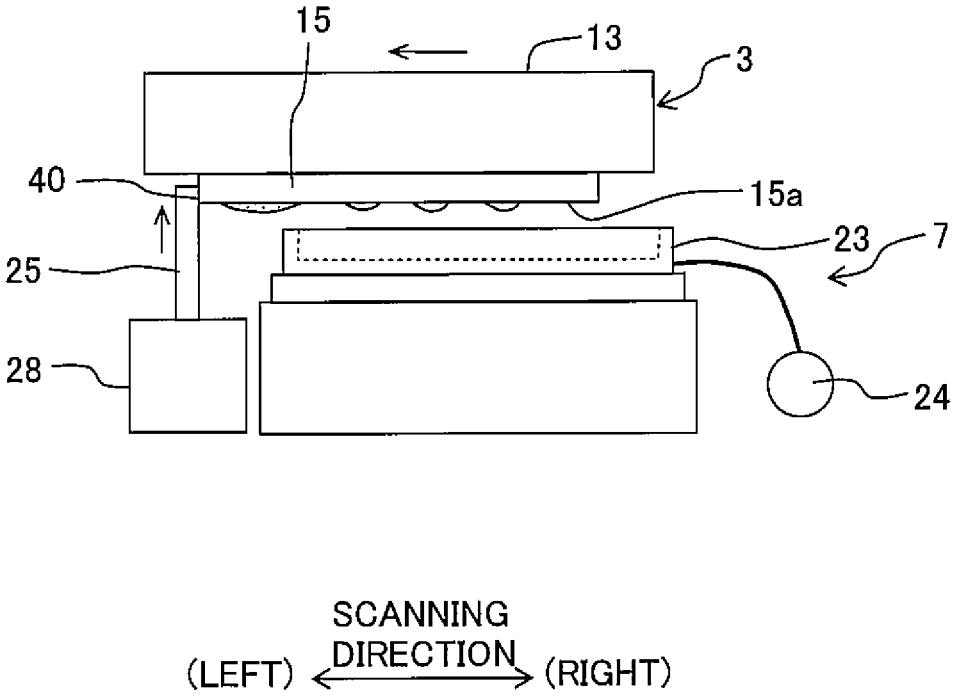
FIG. 5 is a front view of an ink jet head and a maintenance unit according to a modification of the embodiment.

In the above embodiment, as depicted in FIG. 2B, before wiping the ink jet surface 15*a*, the leading end of the wiper 25 has contacted with the left lateral surface 30 of the carriage 13 of the ink jet head 3; therefore, part of the ink adheres to the left lateral surface 30 of the carriage 13. However, the present teaching is not limited to such kind of embodiment. As depicted in FIG. 5, for example, the wiper 25 may contact with a lateral surface 40 of the ink jet unit 15 but not with the carriage 13 such that part of the ink may adhere to the lateral surface 40 of the ink jet unit 15. Further, it is a matter of course that the cleaning portion 32 for cleaning the lateral surface 40 of the ink jet unit 15 is provided at such a height as to contact with the lateral surface 40 of the ink jet unit 15 when the ink jet head 3 has moved there.

<Second Modification>

Figure 6:
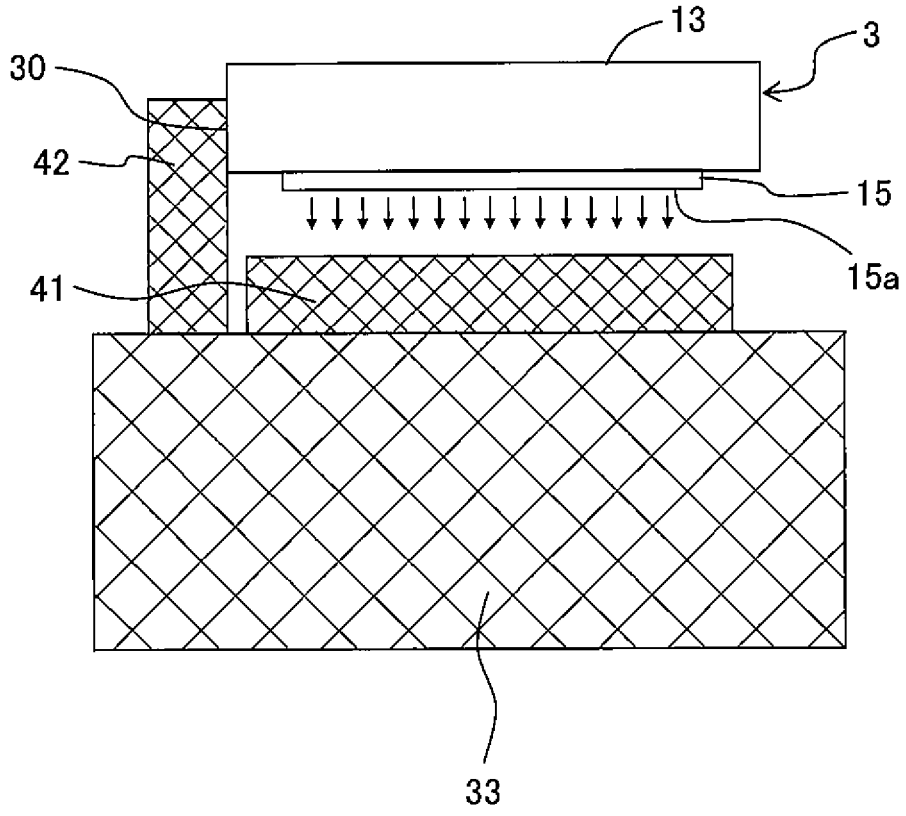
FIG. 6 is a front view of an ink jet head, a flushing receiving member, and a cleaning member according to another modification.

In the above embodiment, the cleaning portion 32 and the flushing receiving portion 31 are formed from an integrated member, that is, formed as the ink receiving member 8, while the ink absorption member 33 is connected to the ink receiving member 8. However, the present teaching is not limited to such kind of configuration. As depicted in FIG. 6 for example, a flushing receiving member 41 and a cleaning member 42 may be formed from different members. In such cases, as depicted in FIG. 6, it is preferable to also connect the cleaning member 42 to the ink absorption member 33 connected to the flushing receiving member 41. Further, the cleaning member, the flushing receiving member, and the ink absorption member may be formed as an integrated member. For example, the ink absorption member 33 may be constructed into such a form as to include the cleaning portion 32 and the flushing receiving portion 31 depicted in FIG. 3, or part of the ink absorption member 33 may be constructed to function as a cleaning member.

<Third Modification>

The cleaning member need not be located in the same position (the flushing position B) as that in which the flushing receiving member is located. For example, when the wiper 25 wipes the ink jet surface 15*a* in such a direction (that is, the movement direction of the wiper 25 relative to the ink jet head 3) as opposed to the direction depicted in FIG. 2B in the above embodiment, then part of the ink may adhere to the right lateral surface of the carriage 13. In this case, in order to be able to clean the right lateral surface of the ink jet head 3, the cleaning member is preferably arranged in an end position on the right side in the movement range.

Further, the cleaning member need not necessarily be located in an end position in the range for the ink jet head 3 to move, but may be arranged in a central position according to the scanning direction. In such a case, however, in order for the ink jet head 3 not to come in the way when jetting the ink to the recording paper P, it is preferable to configure the cleaning member as capable of retreating back to a position without contact with the carriage 13 by being moved vertically relative to the ink jet head 3.

<Fourth Modification>

It is not necessary for the cleaning member to clean the lateral surface of the ink jet head 3 by cooperatively carrying out the suction purge, the wiping of the ink jet surface 15*a* with the wiper 25 and the flushing, but the cleaning member may carry out the cleaning operation at any timing. For example, in the above embodiment, right after carrying out the wiping with the wiper 25, the ink jet head 3 is moved to the flushing position for the cleaning member to carry out the cleaning simultaneously with the flushing. In contrast to this, the cleaning member may carry out the cleaning independently from other operations such as moving the ink jet head 3 to contact with the cleaning member, etc., at a right timing after some time has passed since the wiper 25 carried out the wiping.

<Fifth Modification>

In the above embodiment, the wiper 25 is fixed in position. Further, because of the movement of the ink jet head 3 in the scanning direction, the wiper 25 carries out the wiping in moving relative to the ink jet surface 15*a* in the scanning direction. In contrast to this, the ink jet surface 15*a* may be wiped by moving the wiper per se relative to the ink jet head 3 with a drive portion of an appropriate configuration including a motor and the like.

<Sixth Modification>

In the above embodiment, the wiper 25 contacts with a lateral surface of the ink jet head 3 (the carriage 13 or the ink jet unit 15) according to the scanning direction before wiping the ink jet surface 15*a* and, therefore, part of the ink adheres to that lateral surface. In contrast to this, depending on the configuration of the wiper 25, part of the ink may adhere to a lateral surface of the ink jet head 3 according to the conveyance direction (the front-rear direction).

For example, even if the wiper 25 wipes in the scanning direction, part of the ink may still adhere to the lateral surface on the front or rear side of the ink jet head 3 (the carriage 13 or the ink jet unit 15) because of the wiper 25 also sweeps the ink in the front-rear direction when wiping off the same from the ink jet surface 15*a*.

Further, when such a configuration is adopted that the wiper 25 is movable relative to the ink jet head 3, then it is also possible for the wiper 25 to wipe not in the scanning direction but in the conveyance direction (the front-rear direction). In this manner, when the wiper 25 moves in the conveyance direction relative to the ink jet surface 15*a*, then because the wiper 25 contacts with the lateral surface of the ink jet head 3 (the carriage 13 or the ink jet unit 15) on the front or rear side before wiping the ink jet surface 15*a*, part of the ink is to adhere to either of those lateral surfaces.

Figure 7:
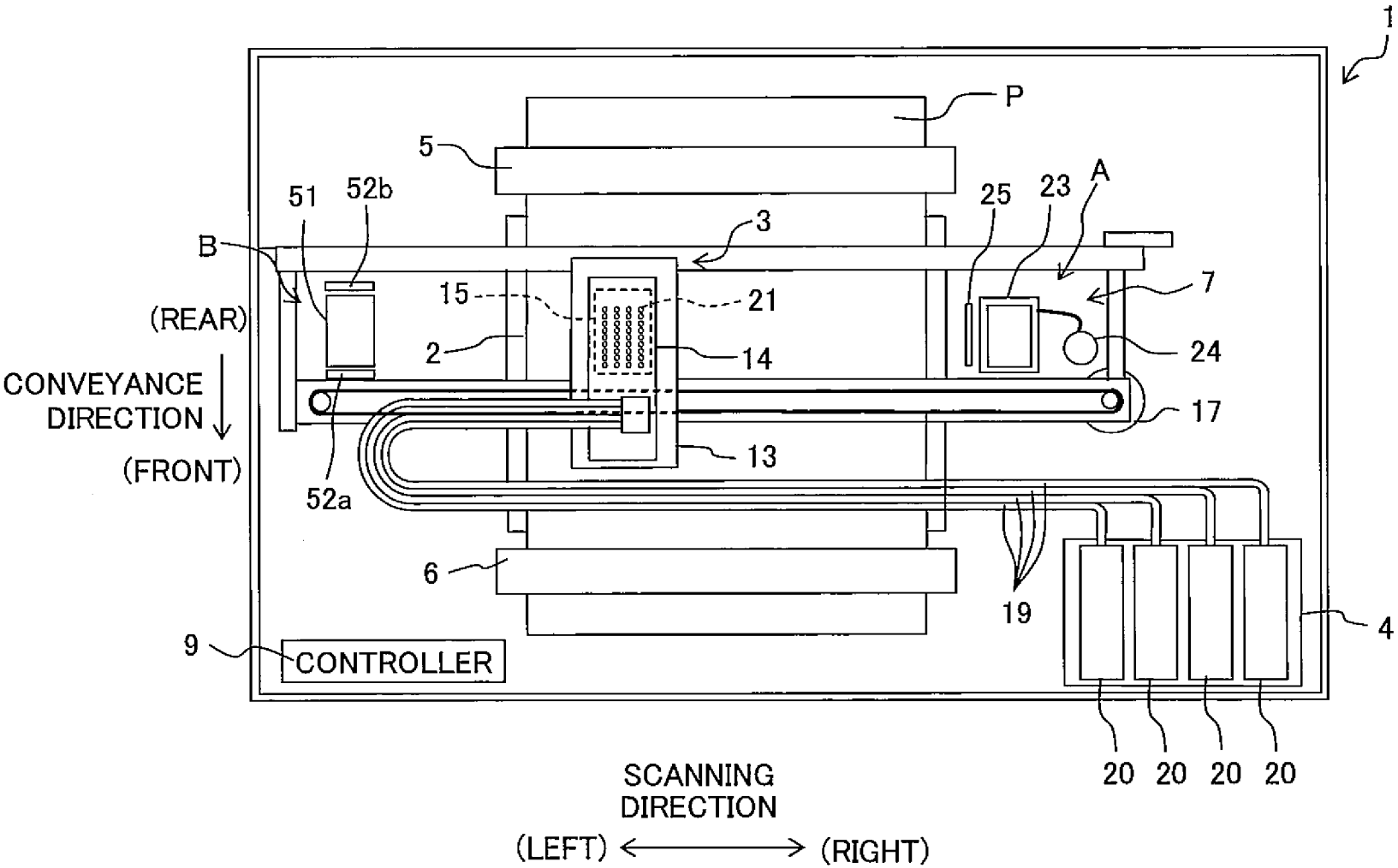
FIG. 7 is a schematic plan view of a printer according to still another modification.

In this manner, when cleaning the lateral surface of the ink jet head 3 on the front or rear side, the cleaning member is arranged to contact with one or both of the lateral surfaces of the ink jet head 3 on the front and rear sides. For example, in FIG. 7, two cleaning members 52*a* and 52*b* are arranged respectively in positions on the front side and on the rear side of the flushing receiving member 51. By virtue of this, when the ink jet head 3 has moved to the flushing position B, the lateral surface of the ink jet unit 15 on the front side comes to contact with the cleaning member 52*a* whereas the lateral surface of the ink jet head 3 on the rear side comes to contact with the cleaning member 52*b*. Therefore, the two lateral surfaces on the front and rear sides are cleaned simultaneously.

<Seventh Modification>

In order to easily remove the ink adhering to a lateral surface of the ink jet head 3, the cleaning member may move relative to that lateral surface while being in contact with the lateral surface of the ink jet head 3.

Figure 8:
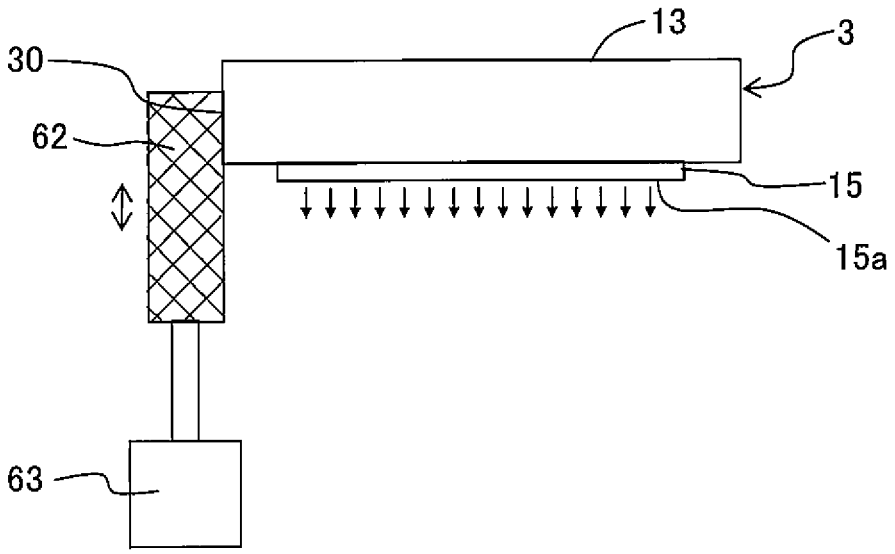
FIG. 8 is a front view of an ink jet head, a cleaning member, and a cleaning movement unit according to still another modification.

In FIG. 8, a cleaning member 62 is linked to a cleaning movement unit 63 to vertically move the cleaning member 62. With the cleaning member 62 being in contact with the lateral surface 30 of the carriage 13, the cleaning movement unit 63 minutely vibrates the cleaning member 62 in the up-down direction parallel to the lateral surface 30 of the carriage 13. That is, in addition to moving the ink jet head 3 to cause the cleaning member 62 to contact with the lateral surface 30 so that the cleaning member 62 absorbs the ink adhering to the lateral surface 30, the cleaning movement unit 63 further moves the cleaning member 62 relative to the lateral surface 30 of the ink jet head 3. By virtue of this, even when the thickened ink is caked or solidly attached on the lateral surface 30 of the ink jet head 3, it is still possible to reliably remove that ink. Further, it is possible to use a motor, a cylinder or the like as the actuator of the cleaning movement unit 63. Further, because it is sufficient for the cleaning member 62 to move to the extent of minute vibration, it is also possible to use a piezoelectric actuator. Further, the cleaning movement unit 63 may also move the cleaning member 62 in the front-rear direction.

Alternatively, in FIG. 8, the cleaning movement unit 63 may move the cleaning member 62 in the left-right direction orthogonal to the lateral surface 30 of the ink jet head 3. When the lateral surface 30 of the ink jet head 3 contacts with the cleaning member 62, even with a small pressing force against the cleaning member 62, it is still possible to reliably remove the ink adhering to the lateral surface 30 by moving the cleaning member 62 in the left-right direction so as to intensively press the cleaning member 62 against the carriage 13.

<Eighth Modification>

In the above seventh modification, the cleaning member 62 is configured to contact with the lateral surface 30 of the ink jet head 3. However, the present teaching is not limited to such a configuration but, for example, the cleaning member 62 may be configured to face the lateral surface 30 of the ink jet head 3 at an interval across a slight gap. In such a configuration, when the cleaning member 62 can contact with the ink adhering to the lateral surface 30 of the ink jet head 3, then it is possible for the cleaning member 62 to absorb the ink adhering to the lateral surface 30. In other words, the cleaning member 62 may be configured not to contact with the lateral surface 30 of the ink jet head 3, but to face the lateral surface 30 at an interval across such a slight gap as contactable with the ink adhering to the lateral surface 30 of the ink jet head 3. In such a case, it is still possible for the cleaning member 62 to absorb the ink adhering to the lateral surface 30.

<Ninth Modification>

Figure 9:
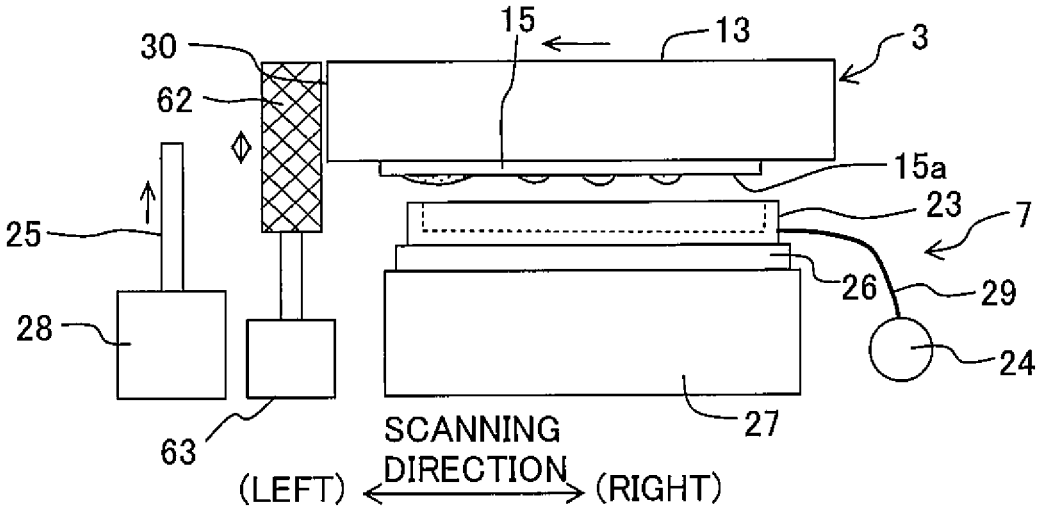
FIG. 9 is a front view of an ink jet head, a maintenance unit, a cleaning member, and a cleaning movement unit according to still another modification.

In the embodiment, the ink jet head 3 is moved to the flushing position B at which the ink jet head 3 faces the flushing receiving portion 31. During the flushing operation, the ink is jetted from the ink jet head 3 toward the flushing receiving portion 31. However, the present teaching is not limited to such a configuration. For example, the ink jet head 3 may be moved to a facing position at which the ink jet head 3 faces the cap member 23. During the flushing operation, the ink may be jetted from the ink jet head 3 toward the cap member 23. In this case, as depicted in FIG. 9, the cleaning member 62 and the cleaning movement unit 63 may be provided between the wiper 25 and the cap member 23. In this case, during the flushing operation in which the ink is jetted from the ink jet head 3 toward the cap member 23, it is possible to clean the lateral surface 30 of the carriage 13 (the ink jet head 3) by moving the cleaning member 62 vertically by the cleaning movement unit 63.

In the embodiment and its modifications described above, the present teaching is applied to an ink jet printer which jets ink to recording paper to print images and the like thereon. However, the present teaching may also be applied to any liquid discharge apparatus used for various purposes other than printing images and the like. For example, it is also possible to apply the present teaching to liquid discharge apparatuses which jet an electrically conductive liquid to a substrate to form a conductive pattern on a surface of the substrate.

What is claimed is:

1. A liquid discharge apparatus configured to discharge liquid, comprising:

a liquid jet head including a lateral surface and a liquid jet surface in which a plurality of nozzles is formed, and being configured to move in a scanning direction;

a head movement unit configured to supply the liquid jet head with a power for moving the liquid jet head in the scanning direction;

a wiper configured to wipe off liquid adhered to the liquid jet surface of the liquid jet head by moving relative to the liquid jet head in a relative-moving direction; and a cleaning member configured to attract the liquid into the cleaning member, provided within a range for the liquid jet head to move in the scanning direction, and configured to contact with the liquid adhering to the lateral surface of the liquid jet head by a movement of the liquid jet head in the scanning direction;

wherein the lateral surface of the liquid jet head is perpendicular to the relative-moving direction.

2. The liquid discharge apparatus according to claim 1;

wherein the clearing member is configured to contact with the lateral surface of the liquid jet head by the movement of the liquid jet head in the scanning direction.

3. The liquid discharge apparatus according to claim 2, further comprising:

a cap member configured to cover the liquid jet surface of the liquid jet head;

a pump configured to apply a pressure to the liquid in the nozzles to discharge the liquid from the nozzles;

a flushing receiving member arranged to face the liquid jet surface in the end position at which the cleaning member is arranged within the range for the liquid jet head to move in the scanning direction; and a controller configured to control operations of the liquid jet head, the head movement unit, the wiper, and the pump;

wherein the cleaning member is arranged in an end position within the range for the liquid jet head to move in the scanning direction;

wherein the controller is configured to carry out:

discharging the liquid from the plurality of nozzles in the liquid jet surface by actuating the pump with the liquid jet surface being covered by the cap member, controlling the wiper to wipe the liquid jet surface after discharging the liquid from the plurality of nozzles in the liquid jet surface by actuating the pump, controlling the head movement unit to move the liquid jet head toward the end position at which the flushing receiving member is arranged after wiping the liquid jet surface, and controlling the liquid jet head to jet the liquid from the plurality of nozzles toward the flushing receiving member; and wherein under a condition that the liquid jet head has moved to the end position to perform a flushing, the lateral surface of the liquid jet head contacts with the cleaning member to remove the liquid adhered on the lateral surface of the liquid jet head.

4. The liquid discharge apparatus according to claim 2, further comprising:

a cap member configured to cover the liquid jet surface of the liquid jet head;

a pump configured to apply a pressure to the liquid in the nozzles to discharge the liquid from the nozzles;

a controller configured to control operations of the liquid jet head, the head movement unit, the wiper, and the pump;

wherein the cleaning member is arranged in an end position within the range for the liquid jet head to move in the scanning direction;

wherein the controller is configured to carry out:

discharging the liquid from the plurality of nozzles in the liquid jet surface by actuating the pump with the liquid jet surface being covered by the cap member, controlling the wiper to wipe the liquid jet surface after discharging the liquid from the plurality of nozzles in the liquid jet surface by actuating the pump, controlling the head movement unit to move the liquid jet head to a facing position at which the liquid jet head faces the cap member after wiping the liquid jet surface, and controlling the liquid jet head to jet the liquid from the plurality of nozzles toward the cap member; and wherein under a condition that the liquid jet head has moved to the facing position to perform a flushing, the lateral surface of the liquid jet head contacts with the cleaning member to remove the liquid adhered on the lateral surface of the liquid jet head.

5. The liquid discharge apparatus according to claim 2;

wherein the cleaning member is arranged in an end position within the range for the liquid jet head to move in the scanning direction, wherein the range includes a printing-scanning range in which the liquid jet head is scanned to discharge the liquid onto the medium and an adjacent range which includes the end position and is arranged adjacent to the printing-scanning range in the scanning direction;

wherein the liquid discharge apparatus further comprises:

a conveyance mechanism configured to convey a medium onto which the liquid is to be discharged in a conveyance direction intersecting the scanning direction; and a controller configured to control the liquid jet head and the conveyance mechanism to:

move the liquid jet head within the printing-scanning range so that the lateral surface of the liquid jet head does not contact with the cleaning member, under a condition that the liquid is discharged onto the medium, and move the liquid jet head to the adjacent range so that the cleaning member is deformed by contacting with the lateral surface of the liquid jet head, under a condition that a cleaning condition for cleaning the lateral surface of the liquid jet head is satisfied.

6. The liquid discharge apparatus according to claim 5;

wherein the wiper is configured to wipe the liquid jet surface of the liquid jet head while being in contact with the lateral surface of the liquid jet head on one side according to the scanning direction under a condition that the liquid jet head moves to the one side in the scanning direction; and the cleaning member is arranged in the end position of the liquid jet head on the one side according to the scanning direction, and configured to contact with the lateral surface of the liquid jet head on the one side under a condition that the liquid jet head moves to the end position on the one side.

7. The liquid discharge apparatus according to claim 5;

wherein the controller is configured to control the head movement unit to move the liquid jet head to let the lateral surface of the liquid jet head contact with the cleaning member, just after wiping the liquid jet surface by the wiper.

8. The liquid discharge apparatus according to claim 5, further comprising:

a cap member configured to cover the liquid jet surface of the liquid jet head;

a pump configured to apply a pressure to the liquid in the nozzles to discharge the liquid from the nozzles;

a flushing receiving member arranged to face the liquid jet surface in the end position at which the cleaning member is arranged within the range for the liquid jet head to move in the scanning direction; and a controller configured to control operations of the liquid jet head, the head movement unit, the wiper, and the pump;

wherein the controller is configured to carry out:

discharging the liquid from the plurality of nozzles in the liquid jet surface by actuating the pump with the liquid jet surface being covered by the cap member, controlling the wiper to wipe the liquid jet surface after discharging the liquid from the plurality of nozzles in the liquid jet surface by actuating the pump, controlling the head movement unit to move the liquid jet head to the end position at which the flushing receiving member is arranged after wiping the liquid jet surface, and controlling the liquid jet head to jet the liquid from the plurality of nozzles toward the flushing receiving member;

under a condition that the liquid jet head has moved to the end position, the lateral surface of the liquid jet head comes to contact with the cleaning member arranged in the end position, under a condition that the controller controls the liquid jet head to perform a flushing, the lateral surface of the liquid jet head contacts with the cleaning member to remove the liquid adhered on the lateral surface of the liquid jet head.

9. The liquid discharge apparatus according to claim 8;

wherein the flushing receiving member and the cleaning member are connected with a common liquid absorption member formed of a material of absorbing the liquid.

10. The liquid discharge apparatus according to claim 8;

wherein the flushing receiving member and the cleaning member are connected with each other, and formed of a material of absorbing the liquid.

11. The liquid discharge apparatus according to claim 2, further comprising:

a cleaning-member movement unit configured to move the cleaning member relative to the lateral surface of the liquid jet head in a state that the cleaning member contacts with the lateral surface of the liquid jet head by the movement of the liquid jet head in the scanning direction.

12. The liquid discharge apparatus according to claim 11;

wherein the cleaning-member movement unit is configured to move the cleaning member in a direction parallel to the lateral surface of the liquid jet head with the cleaning member being in contact with the lateral surface of the liquid jet head.

13. The liquid discharge apparatus according to claim 11;

wherein the cleaning-member movement unit comprises an actuator mechanism adapted to vibrate the cleaning member with the cleaning member being in contact with the lateral surface of the liquid jet head.

14. A liquid discharge apparatus configured to discharge liquid, comprising:

a liquid jet head including a liquid jet surface in which a plurality of nozzles is formed, and being configured to move in a scanning direction;

a head movement unit configured to supply the liquid jet head with a power for moving the liquid jet head in the scanning direction;

a wiper configured to wipe off the liquid adhered to the liquid jet surface of the liquid jet head by moving relative to the liquid jet head in a relative moving direction;

a cleaning member configured to attract the liquid into the cleaning member; and a controller configured to control the liquid jet head and the head movement unit to carry out a flushing operation in which the liquid is discharged from the liquid jet head, upon letting the cleaning member contact with a lateral surface of the liquid jet head to remove the liquid adhering to the lateral surface of the liquid jet head;

wherein the lateral surface of the liquid jet head is perpendicular to the relative-moving direction.

15. The liquid discharge apparatus according to claim 1, further comprising:

a flushing receiving member having a length in the scanning direction that is shorter than that of the liquid jet head;

wherein a distance between a lateral surface of the cleaning member facing the lateral surface of the liquid jet head and a center of the flushing receiving member in the scanning direction is not greater than a distance between the lateral surface of the liquid jet head and the center of the flushing receiving member in the scanning direction.

16. The liquid discharge apparatus according to claim 15;

wherein regarding a first direction from the liquid jet surface toward a top surface of the flushing receiving member facing the liquid jet surface, a length of the cleaning member from the top surface of the flushing receiving member is longer than a distance between the liquid jet surface and the top surface of the flushing member.

17. The liquid discharge apparatus according to claim 15;

wherein the cleaning member is connected to a portion of the flushing receiving member, the portion being located at a position in which a distance from one end of the flushing receiving member is longer than a length of the liquid jet head in the scanning direction.

18. The liquid discharge apparatus according to claim 15, further comprising;

a platen;

wherein the wiper is located outside the platen at one side in the scanning direction, and the cleaning member is located outside the platen at the other side in the scanning direction.

19. The liquid discharge apparatus according to claim 9;

wherein the liquid absorption member is configured to absorb larger amount of the liquid than the flushing receiving member and the cleaning member.

* * * * *